US008127723B2

(12) United States Patent
Lee

(10) Patent No.: US 8,127,723 B2
(45) Date of Patent: Mar. 6, 2012

(54) COOLING CIRCUIT OF ENGINE

(75) Inventor: Bong Sang Lee, Gyunggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 406 days.

(21) Appl. No.: 12/512,793

(22) Filed: Jul. 30, 2009

(65) Prior Publication Data

US 2010/0122671 A1 May 20, 2010

(30) Foreign Application Priority Data

Nov. 18, 2008 (KR) ..... 10-2008-0114794

(51) Int. Cl.
*F01P 7/14* (2006.01)

(52) U.S. Cl. ..... 123/41.1; 123/41.31; 123/41.44; 123/41.72

(58) Field of Classification Search ..... 123/41.05, 123/41.08, 41.09, 41.1, 41.31, 41.44, 41.72, 123/543, 545; 236/34.5
See application file for complete search history.

(56) References Cited

U.S. PATENT DOCUMENTS 3,851,629 A * 12/1974 Mayr et al. ..... 123/41.08
(Continued)

FOREIGN PATENT DOCUMENTS

JP 2008286029 A * 11/2008

*Primary Examiner* — Michael Cuff
*Assistant Examiner* — Hung Q Nguyen
(74) *Attorney, Agent, or Firm* — Morgan, Lewis & Bockius LLP

(57) ABSTRACT

A cooling circuit of an engine may include a water pump provided at a coolant circulation line, an engine provided with a water jacket forming a pathway through which a coolant supplied from the water pump passes, and having a coolant inflow line and a coolant exhaust line, a radiator connected to the coolant exhaust line, a thermostat selectively connecting the radiator with the water pump to control a coolant flow, a first cooling line connecting the coolant exhaust line to a heater, a first return line connecting the heater to the water pump through the thermostat, a second cooling line connecting the coolant exhaust line to a throttle body, a third cooling line connecting the throttle body to an oil cooler, and a second return line connecting the oil cooler to the first return line to guide a coolant exhausted from the oil cooler to the first return line.

12 Claims, 1 Drawing Sheet

U.S. PATENT DOCUMENTS 3,877,443 A * 4/1975 Henning et al. ..... 123/41.08
5,419,287 A * 5/1995 Evans ..... 123/41.29
6,182,616 B1 * 2/2001 Itoh et al. ..... 123/41.1
6,568,356 B1 * 5/2003 Hayakawa et al. ..... 123/41.1
6,644,261 B2 * 11/2003 Morii et al. ..... 123/195 R
6,732,679 B2 * 5/2004 Iizuka ..... 123/41.1
6,758,173 B2 * 7/2004 Saito et al. ..... 123/41.74
6,761,321 B2 * 7/2004 Takahashi ..... 236/34.5
6,857,398 B2 * 2/2005 Takagi et al. ..... 123/41.1
2002/0189556 A1 * 12/2002 Morii et al. ..... 123/41.1
2003/0111025 A1 * 6/2003 Kim ..... 123/41.72
2003/0150406 A1 * 8/2003 Takagi et al. ..... 123/41.1

* cited by examiner

COOLING CIRCUIT OF ENGINE

CROSS-REFERENCE TO RELATED APPLICATION

The present application claims priority to Korean Patent Application No. 10-2008-0114794 filed on Nov. 18, 2008, the entire contents of which are incorporated herein by reference.

BACKGROUND OF THE INVENTION

1. Field of the Invention

The present invention relates to an engine. More particularly, the present invention relates to a cooling circuit of an engine.

2. Description of Related Art

Generally, auxiliary machinery is mounted at an engine, and the auxiliary machinery is various types of machine that support an operation of the engine.

In addition, devices for improving engine output are also mounted at the engine. For example, a turbo charger for supplying more air to the engine may be mounted. In the turbo charger, a turbine is rotated by an exhaust gas exhausted through an exhaust manifold so as to supply more air into the engine.

In a case that the number of auxiliary machinery mounted at the engine increases as described above, it is important to mount a preferable cooling circuit at the engine. The cooling circuit affects performance of the engine as well as durability and performance of each machine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a cooling circuit of an engine having advantages of simplifying a cooling circuit without decreasing coolant amount supplied to peripheral devices by improving the cooling circuit disposed between the engine and the peripheral devices.

In an aspect of the present invention, the cooling circuit of an engine may include a water pump provided at a coolant circulation line, an engine provided with a water jacket forming a pathway through which a coolant supplied from the water pump passes, and having a coolant inflow line and a coolant exhaust line connected to the pathway, a radiator connected to the coolant exhaust line of the engine, a thermostat selectively connecting the radiator with the water pump so as to control a coolant flow therebetween, a first cooling line connecting the coolant exhaust line to a heater, a first return line connecting the heater to the water pump through the thermostat, a second cooling line connecting the coolant exhaust line to a throttle body, a third cooling line connecting the throttle body to an oil cooler, and a second return line connecting the oil cooler to the first return line so as to guide a coolant exhausted from the oil cooler to the first return line.

The coolant exhaust line may be connected to peripheral devices.

The thermostat may connect the radiator with the water pump in a case that a temperature of a coolant supplied from the radiator is equal to or higher than a predetermined temperature.

The throttle body may be disposed above the oil cooler so as to guide a downward flow of a coolant from the throttle body to the oil cooler through the third cooling line.

The thermostat may include a main line receiving a coolant supplied from the radiator and selectively supplying the coolant to the water pump, and a bypass line connected to the main line, and directly supplying a coolant returned from the first return line and the coolant returned from the oil cooler to the water pump, wherein the main line may selectively supply the coolant supplied from the radiator to the water pump in a case that a temperature of the coolant supplied from the radiator is equal to or higher than a predetermined temperature.

The main line and the bypass line may be integrally formed in the thermostat.

A main valve may be mounted on the main line and is opened or closed according to a temperature of the coolant supplied from the radiator so as to control the coolant flow supplied to the water pump, wherein the mail valve is disposed in a rear portion of a junction of the mail line and the bypass line, and wherein the main valve is opened in a case that a temperature of the coolant supplied from the radiator is equal to or higher than a predetermined temperature.

The bypass line may be provided with a non-bypass valve that directly passes the coolant supplied from the heater and the oil cooler.

An oil filter for filtering foreign substances in an engine oil may be provided at a lower portion of the oil cooler such that the engine oil is cooled by a coolant passing through the oil cooler.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

Figure 1:
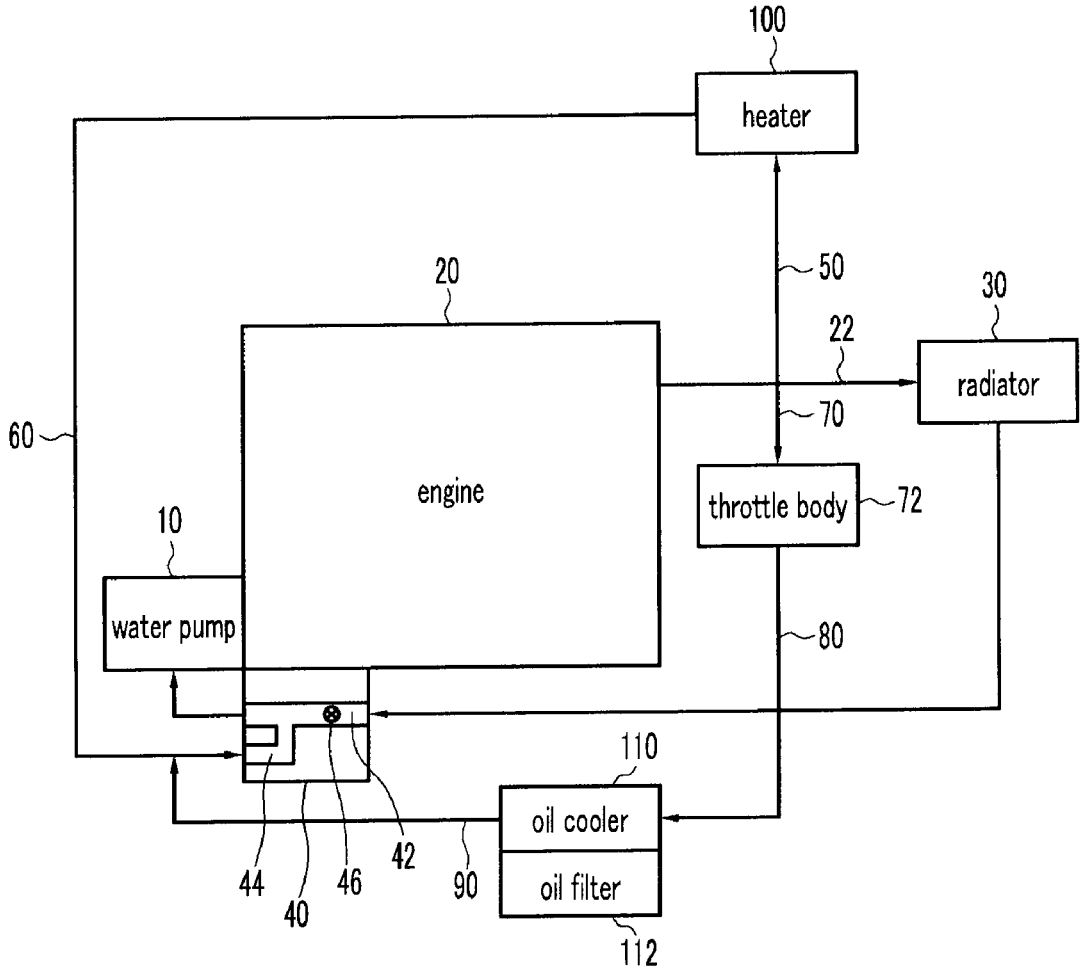
FIG. 1 is a schematic diagram of a cooling circuit of an engine according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

FIG. 1 is a schematic diagram of a cooling circuit of an engine according to an exemplary embodiment of the present invention.

Referring to FIG. 1, a cooling circuit of an engine 20 according to an exemplary embodiment of the present invention includes a cooling circuit that is disposed between the engine 20 and peripheral devices.

The cooling circuit includes a water pump 10, the engine 20, a radiator 30, a thermostat 40, a first cooling line 50, a first return line 60, a second cooling line 70, a third cooling line 80, and a second return line 90. In this specification, the engine 20, the peripheral devices, and the cooling circuit related thereto will be briefly described as shown in FIG. 1, but other cooling circuits that can be mounted at the engine 20 should not be limited to this.

The water pump 10 is mounted on a coolant circulation line, and supplies a coolant to the coolant circulation line so as for the coolant to circulate through the coolant circulation line according to an operation of the engine 20.

The engine 20 has a water jacket through which the coolant supplied from the water pump 10 passes and a coolant exhaust line 22 and a coolant inflow line connected to the peripheral devices.

The radiator 30 is connected to the coolant exhaust line 22 of the engine 20.

The thermostat 40 is connected between the radiator 30 and the water pump 10 and controls flow of the coolant. The thermostat 40 includes a main line 42 and a bypass line 44 therein.

The main line 42 supplies the coolant flowed from the radiator 30 to the water pump 10. A main valve 46 is mounted on the main line 42. The main valve 46 is opened or closed according to a temperature of the coolant flowed from the radiator 30 so as to control the flow of the coolant supplied to the water pump 10.

The bypass line 44 is provided separately from the main line 42, and guides the coolant returned from the first return line 60 to the water pump 10. The bypass line 44 is connected to one side of the main line 42. The bypass line 44 is provided with a non-bypass valve that always passes the coolant.

The first cooling line 50 connects the coolant exhaust line 22 to the heater 100.

The first return line 60 connects the heater 100 to the thermostat 40, and guides the coolant passing through the heater 100 to the thermostat 40.

The second cooling line 70 connects the coolant exhaust line 22 to the throttle body 72.

As described above, the coolant passing through the water jacket of the engine 20 is supplied to the heater 100 and the throttle body 72. The coolant supplied to the heater 100 is used for heating the inside of a vehicle, and the coolant supplied to the throttle body 72 is used for warming up the throttle body 72.

The third cooling line 80 connects the throttle body 72 to an oil cooler 110 of a turbo charger. The turbo charger includes a turbo charger intercooler. The turbo charger intercooler means an intercooler added to the turbo charger. An oil filter 112 is mounted at a lower end of the oil cooler 110. Therefore, an engine oil passes through and is filtered by the oil filter 112, and is cooled by the coolant passing through the oil cooler 110.

Meanwhile, the throttle body 72 is disposed above the oil cooler 110 so as to guide the coolant flowed from the throttle body 72 to the oil cooler 110 through the third cooling line 80 downwardly.

When the engine 20 is operated, an exhaust turbine of the turbo charger is rotated by exhaust energy of the exhaust gas exhausted from the exhaust manifold of the engine 20. The exhaust turbine is directly coupled to a compressor, and thus the compressor is also rotated by the rotation of the exhaust turbine. If the compressor rotates, air flowed into an intake manifold through an air cleaner is compressed to high pressure and is inhaled.

The compressed air is cooled by the intercooler, and the low-temperature and high-pressure air is supplied to the intake manifold. Therefore, the engine 20 provided with the turbo charger draws more air into the engine 20 than a conventional engine.

If the coolant is flowed in oil cooler 110 through the third cooling line 80, temperature of the oil cooler 110 is affected by the coolant. The coolant passing through the oil cooler 110 is returned to the thermostat 40 through the second return line 90.

The second return line 90 connects the oil cooler 110 to the first return line 60, and guides the coolant exhausted from the oil cooler 110 to the first return line 60.

Referring to FIG. 1, the flow of the coolant in the cooling circuit of an engine according to an exemplary embodiment of the present invention will be described in detail.

When the engine 20 is started up, the coolant for cooling the engine 20 is heated by combustion heat occurred in the engine 20. Since the coolant temperature is relatively low before the engine 20 is warmed up, the coolant circulates along the water jacket of the engine 20.

The engine 20 is provided with the water pump 10. The water pump 10 makes the coolant to circulate through the coolant circulation line in order to cool the engine 20. The coolant flowed from the water pump 10 and passing through the engine 20 flowed into the radiator 30 and is then cooled therein.

When the engine 20 is warmed up and the coolant temperature is higher than or equal to a predetermined temperature at this state, the main valve 46 mounted in the thermostat 40 is opened and the coolant cooled in the radiator 30 is flowed into the water pump 10.

Meanwhile, the coolant flowed into the heater 100 through the first cooling line 50 is used for heating the inside of the vehicle. The coolant passing through the heater 100 is returned to the bypass line 44 of the thermostat 40 through the first return line 60. The coolant flowed in the bypass line 44 of the thermostat 40 is supplied to the water pump 10 sequentially through the bypass line 44 and the main line 42 of the thermostat 40.

The second cooling line 70, separately from the first cooling line 50, is connected to the coolant exhaust line 22 of the engine. In addition, the second cooling line 70 is connected to the throttle body 72, and the third cooling line 80 is connected to the throttle body 72.

Therefore, the coolant supplied to the first cooling line 50 through the coolant exhaust line 22 of the engine 20 is supplied to the heater 100, and a part of the coolant is supplied to the oil cooler 110 through the second cooling line 70, the throttle body 72, and the third cooling line 80. The coolant cooling the oil cooler 110 is flowed into the first return line 60 through the second return line 90, and is finally returned to the bypass line 44 of the thermostat 40. In addition, the coolant cooling the oil cooler 110, the same as the coolant passing through the heater 100, is supplied to the water pump 10 through the bypass line 44 and the main line 42 of the thermostat 40.

At this time, the coolant supplied to the heater 100 and the oil cooler 110 is returned to the thermostat 40, and the flow thereof is not shut off regardless of the temperature thereof.

That is, the flow of the coolant flowed in the thermostat 40 through the radiator 30 is controlled according to the coolant temperature by closing or opening the main valve 46.

On the contrary, the coolant that does not pass through the radiator 30 and is returned to the thermostat 40 is directly supplied to the water pump 10 regardless the coolant temperature.

That is, the thermostat 40 is operated according to the temperature of the coolant flowed from the radiator 30 to the thermostat 40, and the coolant flowed from the heater 100 to the thermostat 40 and the coolant flowed to the thermostat 40 through the throttle body 72 and the oil cooler 110 is directly flowed to the water pump 10.

An inlet control type is applied to the cooling circuit according to an exemplary embodiment of the present invention.

The inlet control type means a type where the coolant in the radiator 30 is flowed in the engine 20 according to the temperature of the coolant passing through the engine 20. That is, if temperature of the coolant which passes through the engine 20 and is flowed from the radiator 30 to the thermostat 40 is higher than or equal to the predetermined temperature, the thermostat 40 opens the main valve 46 and the coolant in the radiator 30 is flowed into the thermostat 40. The coolant flowed in the thermostat 40 is mixed with the coolant passing through the heater 100 and the oil cooler 110, and is supplied to the water pump 10.

According to an exemplary embodiment of the present invention as described above, the thermostat 40 controls the flow of the coolant according to the inlet control type and does not shut off the flow of the coolant flowed through the bypass line 44. Since the non-bypass valve is mounted on the bypass line 44, that is the coolant flowed through the bypass line 44 is always flowed in the water pump 10, operability of the thermostat 40 may improve.

The coolant passing through the radiator 30 is shut off according to the temperature of the returned coolant, but the coolant passing through the heater 100 and the oil cooler 110 is not shut off regardless of the coolant temperature. Since the heater 100 and the oil cooler 110 are simultaneously connected to the bypass line 44, the cooling circuit may be simplified without decreasing coolant amount.

According to the cooling circuit of an engine, the thermostat is operated according to a temperature of the coolant flowed from the radiator to the thermostat. In addition, the coolant flowed from an oil cooler of a turbo charger to a thermostat is directly supplied to the water pump. Therefore, cooling circuit may be simplified without decreasing coolant amount.

Since the coolant always circulates through a cooling circuit connected to the oil cooler of the turbo charger, a preferable temperature of engine oil is always maintained.

For convenience in explanation and accurate definition in the appended claims, the terms "downward" and "lower" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cooling circuit of an engine comprising:

a water pump provided at a coolant circulation line;

an engine provided with a water jacket forming a pathway through which a coolant supplied from the water pump passes, and having a coolant inflow line and a coolant exhaust line connected to the pathway of the water jacket;

a radiator connected to the coolant exhaust line of the engine;

a thermostat selectively connecting the radiator with the water pump so as to control a coolant flow therebetween;

a first cooling line connecting the coolant exhaust line to a heater;

a first return line connecting the heater to the water pump through the thermostat;

a second cooling line connecting the coolant exhaust line to a throttle body;

a third cooling line connecting the throttle body to an oil cooler; and a second return line connecting the oil cooler to the first return line so as to guide a coolant exhausted from the oil cooler to the first return line.

2. The cooling circuit of an engine of claim 1, wherein the coolant exhaust line is connected to peripheral devices.

3. The cooling circuit of an engine of claim 1, wherein the thermostat connects the radiator with the water pump in a case that a temperature of a coolant supplied from the radiator is equal to or higher than a predetermined temperature.

4. The cooling circuit of an engine of claim 1, wherein the throttle body is disposed above the oil cooler so as to guide a downward flow of a coolant from the throttle body to the oil cooler through the third cooling line.

5. The cooling circuit of an engine of claim 1, wherein the thermostat comprises:

a main line receiving a coolant supplied from the radiator and selectively supplying the coolant to the water pump; and a bypass line connected to the main line, and directly supplying the coolant returned from the first return line and the coolant returned from the oil cooler to the water pump.

6. The cooling circuit of an engine of claim 5 wherein the main line selectively supplies the coolant supplied from the radiator to the water pump in a case that a temperature of the coolant supplied from the radiator is equal to or higher than a predetermined temperature.

7. The cooling circuit of an engine of claim 5, wherein the main line and the bypass line are integrally formed in the thermostat.

8. The cooling circuit of an engine of claim 5, wherein a main valve is mounted on the main line and is opened or closed according to a temperature of the coolant supplied from the radiator so as to control the coolant flow supplied to the water pump.

9. The cooling circuit of an engine of claim 8, wherein the main valve is disposed in a rear portion of a junction of the main line and the bypass line.

10. The cooling circuit of an engine of claim 8, wherein the main valve is opened in a case that a temperature of the coolant supplied from the radiator is equal to or higher than a predetermined temperature.

11. The cooling circuit of an engine of claim 5, wherein the bypass line is provided with a non-bypass valve that directly passes the coolant supplied from the heater and the oil cooler.

12. The cooling circuit of an engine of claim 1, wherein an oil filter for filtering foreign substances in an engine oil is provided at a lower portion of the oil cooler such that the engine oil is cooled by the coolant passing through the oil cooler.

* * * * *